United States Patent [19]

Rauckhorst et al.

[11] 3,993,926

[45] Nov. 23, 1976

[54] STORAGE TUBE MOVING TARGET DETECTOR

[75] Inventors: Bernard C. Rauckhorst, Akron; Harry O. Pfeiffer, N. Canton, both of Ohio

[73] Assignee: Goodyear Aerospace Corporation, Akron, Ohio

[22] Filed: Oct. 7, 1974

[21] Appl. No.: 512,659

[52] U.S. Cl. ..... 315/10; 313/365

[51] Int. Cl.[2] ..... H01J 31/26

[58] Field of Search ..... 315/10, 11; 313/365, 313/381, 379

[56] References Cited

UNITED STATES PATENTS

| | | | |
|---|---|---|---|
| 2,851,624 | 9/1958 | Sheldon | 315/10 |
| 3,295,010 | 12/1966 | Clayton | 313/381 |
| 3,308,324 | 3/1967 | Asselt | 313/379 |
| 3,406,311 | 10/1968 | Nicholson | 315/11 |
| 3,423,624 | 1/1969 | Steiner | 315/11 |
| 3,424,937 | 1/1969 | Steiner | 315/10 |

*Primary Examiner*—Richard A. Farley
*Assistant Examiner*—T. M. Blum
*Attorney, Agent, or Firm*—J. G. Pere

[57] ABSTRACT

Disclosed is an apparatus and method for determining the presence and position of a moving object within a static field. Basically, the invention utilizes a photocathode in combination with a storage mesh whereby a distributive charge may be stored upon the mesh indicative of light levels within the field. Positive and negative write operations are exercised at different points in time and are superimposed upon the storage mesh. The mesh is then read by means of deflection coils in combination with an aperture plate so as to sequentially scan the storage mesh and emit output signals correlated with the charges upon the mesh after positive and negative write cycles have been exercised. The invention incorporates the fundamental structures of an optical image correlator tube and an image dissector tube.

6 Claims, 11 Drawing Figures

STORAGE TUBE MOVING TARGET DETECTOR

BACKGROUND OF THE INVENTION

In recent years it has become desirous to develop apparatus whereby the presence of a moving object within a static field may be accurately and quickly ascertained. More particularly, with the advent of the space age, it has become desirous that surveillance apparatus be presented whereby a static stellar field may be scanned for the determination of the presence of satellites.

To satisfy these desires, the prior art has taught the utilization of a standard vidicon for scanning the static field. Video signals from the vidicon are then stored within an electronic storage tube for purposes of maintaining a record of the field characteristics at a first point in time. At some later time, further video signals are taken from the vidicon relative to the particular field. These signals are inverted and stored in the electronic storage tube as a record of the characteristics of the field at the later point in time. The resulting difference image can be read out of the electronic storage tube which clearly relates the presence or absence of moving objects within the field. This prior art technique requires complex circuitry to achieve the desired determination and more particularly requires the presence of an input vidicon and inverting circuitry in conjunction with a standard electronic storage tube.

It has been known in the prior art that an optical image correlator tube may be utilized for purposes of storing on a storage mesh thereof data indicative of the relative brightness levels of objects within a field. It has further been known that an image dissector tube may be utilized for purposes of scanning a field as the same is sensed by the photocathode thereof.

To date, there has not been presented any devices incorporating, in a single unit, the storage capabilities of an optical image correlator and the image dissecting capabilities of an image dissector tube wherein the storage mesh may be operated in each of two distinct storage modes with the stored data thereof being dissected and the resultant outputs being analyzed by associated circuitry for the determination of the presence of moving objects and the positions thereof within the field.

It is consequently an object of the instant invention to present a storage tube moving target detector incorporating in a single device the capabilities of both storing and dissecting the stored difference.

A further object of the invention is to present a storage tube moving target detector wherein the storage mesh thereof may be written on in either of two distinct modes by altering the biasing thereof with respect to a photocathode.

Yet another object of the invention is to present a storage tube moving target detector utilizing output circuitry whereby the determination of the presence and position of a moving object within a field may be made.

Still a further object of the invention is to present a storage tube moving target detector which is relatively simplistic in design, inexpensive to construct, highly reliable and accurate in operation, and an advancement over the prior art of such apparatus.

These objects and other objects which will become apparent as the detailed description proceeds are achieved by apparatus for determining the presence and position of a moving object within a field, comprising first means for emitting electrons as a function of the amplitude of light from the field incident thereto; second means for receiving said electrons and storing a distributive charge thereon indicative of time related displacements of moving light levels within the field; and third means for controllably scanning said second means and operative to create output signals as a function of the charge distribution on said second means.

DESCRIPTION OF THE DRAWINGS

For a complete understanding of the structure and techniques of the invention reference should be had to the following detailed description and accompanying drawings wherein:

FIGS. 4A – 4F, is an illustrative showing of the erase, plus and minus write, and read functions in controlling the structure of FIG. 3 and further includes a transconductance curve and a storage mesh secondary emission curve;

DETAILED DESCRIPTION OF THE INVENTION

Figure 1:
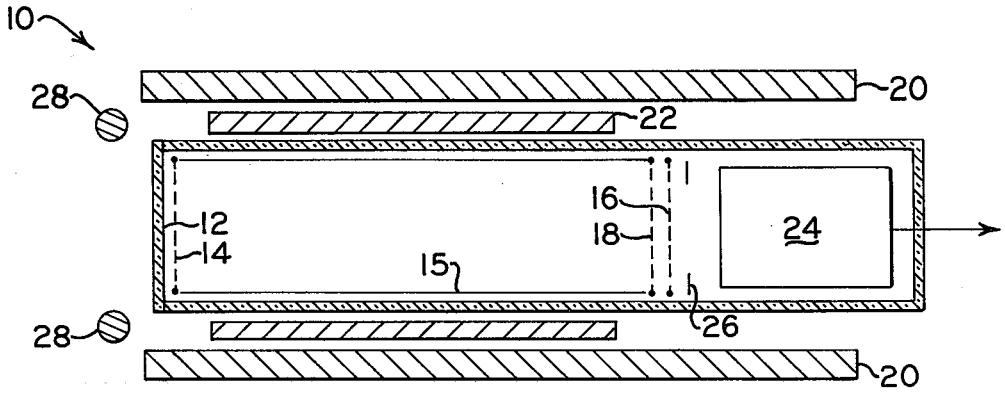
PRIOR ART FIG - 1
FIG. 1 is a sectional view of a prior art optical image correlator showing the elements thereof and their respective positions.

Referring now to the drawings and more particularly FIG. 1, it can be seen that an optical image correlator, as known in the prior art, is designated generally by the numeral 10. For a complete understanding of the structure and function of such a device, reference should be had to U.S. Pat. Nos. 3,424,937; 3,290,546; and 3,423,624, all of which have been assigned to Goodyear Aerospace Corporation of Akron, Ohio. Suffice it to say for purposes of the instant invention that the device 10, which indeed comprises a vacuum tube, contains a light sensitive portion or photo emissive cathode 12 which emits electrons proportional to the amount of light projected thereon. The electrons emitted from the cathode 12 are accelerated by means of a field mesh 14 and then drift to the storage mesh by means of a faraday cage comprised of the field mesh 14, drift tube 15, and collector mesh 18. Such electrons are focused onto the storage grid or mesh 16 by means of proper biasing of a magnetic focusing field produced by a cylindrical permanent magnet or electromagnetic coil or solenoid comprising the focus coils 20. A collector mesh 18 is interposed before the storage mesh 16 to collect electrons that are emitted from the grid 16 as a result of secondary emission during storage. With the electrons emitted from the photocathode 12 being stored upon the mesh 16, there is thus contained thereon a charge pattern indicative of the relative levels of brightness incident to the photocathode 12.

In normal operation of an optical image correlator such as that shown in FIG. 1, a second image would be sensed by the photocathode 12 resulting electrons again being passed therefrom towards the storage mesh 16. The deflection coils 22 provide for electromagnetic deflection of the electron stream passing from the cathode 12 to the mesh 16. A nutating technique implemented by controlling the excitation of the deflection coils 22 provides means for comparing the image bearing electron stream with the image stored upon the mesh 16. The electrons passing through the mesh 16 in the correlation mode are sensed by the multiplier or amplifier 24 such that the amplitude of the output signal thereof is indicative of the degree of correlation between the stored image and the image borne by the electron stream. Of course, a mask 26 may be interposed between the amplifier 24 and the storage grid 16 to limit the effective field sensed by the device. A source of flood illumination 28 may be positioned before the photocathode 12 (as shown) or between the photocathode 12 and field mesh 14 for purposes of erasing images previously stored upon the mesh 16. The normal correlation techniques and control of the structure shown in FIG. 1 is clearly covered in the aforementioned U.S. Patent. It should be specifically noted however that such a device provides a means for storing an optical image as an electron charge pattern.

Figure 2:
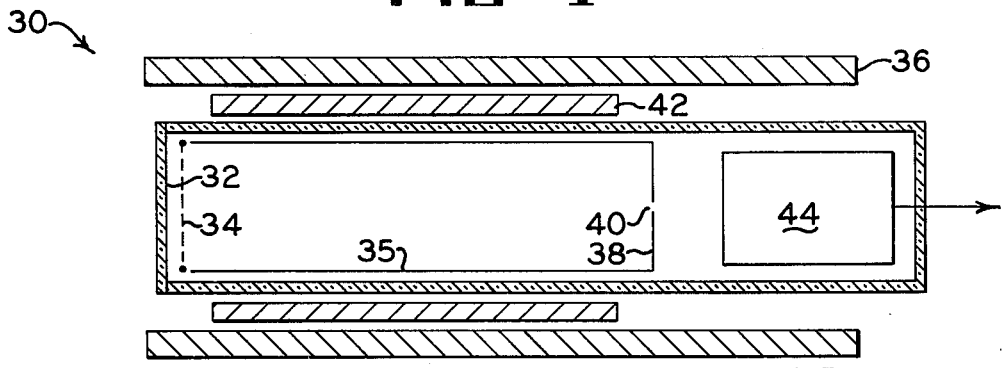
PRIOR ART FIG - 2
FIG. 2 is a sectional view of an image dissector tube of the prior art again showing the basic elements thereof and their respective positions.

In FIG. 2 there is shown in sectional view those elements comprising the commonly known image dissector tube. This tube, designated generally by the numeral 30, again utilizes a photocathode 32 which functions in the same manner as mentioned with respect to the optical image correlator discussed above. Electrons emitted from the photocathode 32 are accelerated by means of a field mesh 34 and then drift to the aperture plate by means of a faraday cage comprised of the field mesh 34, drift tube 35, and aperture plate 38. Such electrons are focused onto the aperture plate 38 by means of the focus coil 36. The aperture 40, preferably centrally located within the plate 38, is of small diameter preferably between 0.5 and 10.0 millinch. By appropriately regulating the excitation of the deflection coils 42 interposed between the field mesh 34 and aperture plate 38, the data field sensed by the cathode 32 and passed as an electron stream to the plate 38 may be sequentially scanned or dissected through the aperture 40 and onto an appropriate electron multiplier 44. Thus, using the structure of FIG. 2, a field may be scanned with recording made by appropriate output circuitry of the electron image emitted from the photocathode 32. Such structure and techniques are well known in the prior art and are only briefly mentioned herein for purposes of relating the fundamental structure required for such a device.

Figure 3:
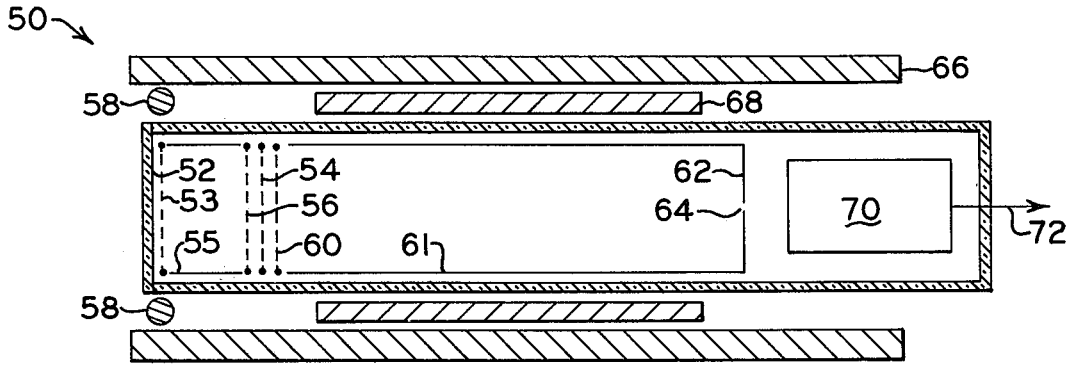
FIG. 3 is a sectional view of the structure of the storage tube moving target detector of the instant invention incorporating certain of the elements of the structures of FIGS. 1 and 2.

In FIG. 3 there is shown a preferred embodiment of the storage tube moving target detector of the invention and the same is designated generally by the numeral 50. Again, there is utilized the commonly known photocathode 52 presented at the front end of the tube and functional to emit electrons therefrom indicative of the light levels incident to the various portions thereof. A storage mesh 54 is utilized as in the optical image correlator of FIG. 1 for storing thereon electron charges resulting from the stream emitted from the cathode 52. Again, electrons emitted from the photocathode 52 are accelerated by means of a field mesh 53 and then drift to the storage mesh by means of a faraday cage comprised of the field mesh 53, drift tube 55, and collector mesh 56. The collector mesh 56 as is standard in the art is also used for receiving secondary electrons from the storage mesh 54. A source of flood illumination 58 is provided between the mesh 53 and cathode 52 for purposes to be discussed hereinafter. It should be well to note that the flood illumination source 58 could be presented in front of the cathode 52 if the tube 50 were to be utilized without an intensifier as will be further mentioned hereinafter. Where a light intensifier is required for low level light sensing, it is preferable that the source 58 be presented behind the photocathode 52 as shown. In either case the source 58 functions in the same manner and performs those functions which will be elaborated upon later.

Further received within the tube 50 and interposed directly behind the storage mesh 54 is a field mesh 60 again provided for purposes of accelerating electrons passing through the storage mesh 54. These electrons then drift to the aperture plate 62 through the faraday cage comprised of field mesh 60, drift tube 61, and aperture plate 62. The aperture plate 62 has a small aperture 64 placed therein. Focus coils 66 are presented along the length of the tube 50 and function in the normal manner. Similarly, electromagnetic deflection coils 68 are interposed between the field mesh 60 and aperture plate 62 for purposes of operating in conjunction with the aperture 64 to dissect the electron stream passing therethrough. In normal manner, an appropriate electron multiplier 70 is operative to receive the electrons passing through the aperture 64 and present an amplified current 72 on the output thereof.

It should be readily apparent to those skilled in the art that the tube 50 presented in FIG. 3 comprises fundamentally an optical image correlator from the photocathode 52 back to and including the storage mesh 54. Of course, the optical image correlator defined thereby is a non-deflectible correlator since the deflection coils 68 are positioned therebeyond. From the storage mesh 54 back to the electron multiplier 70 the tube 50 fundamentally comprises a dissector tube as discussed hereinabove with respect to FIG. 2. Thus there is combined within the same structure the fundamental elements comprising an optical image correlator and a dissector tube.

Figure 4:
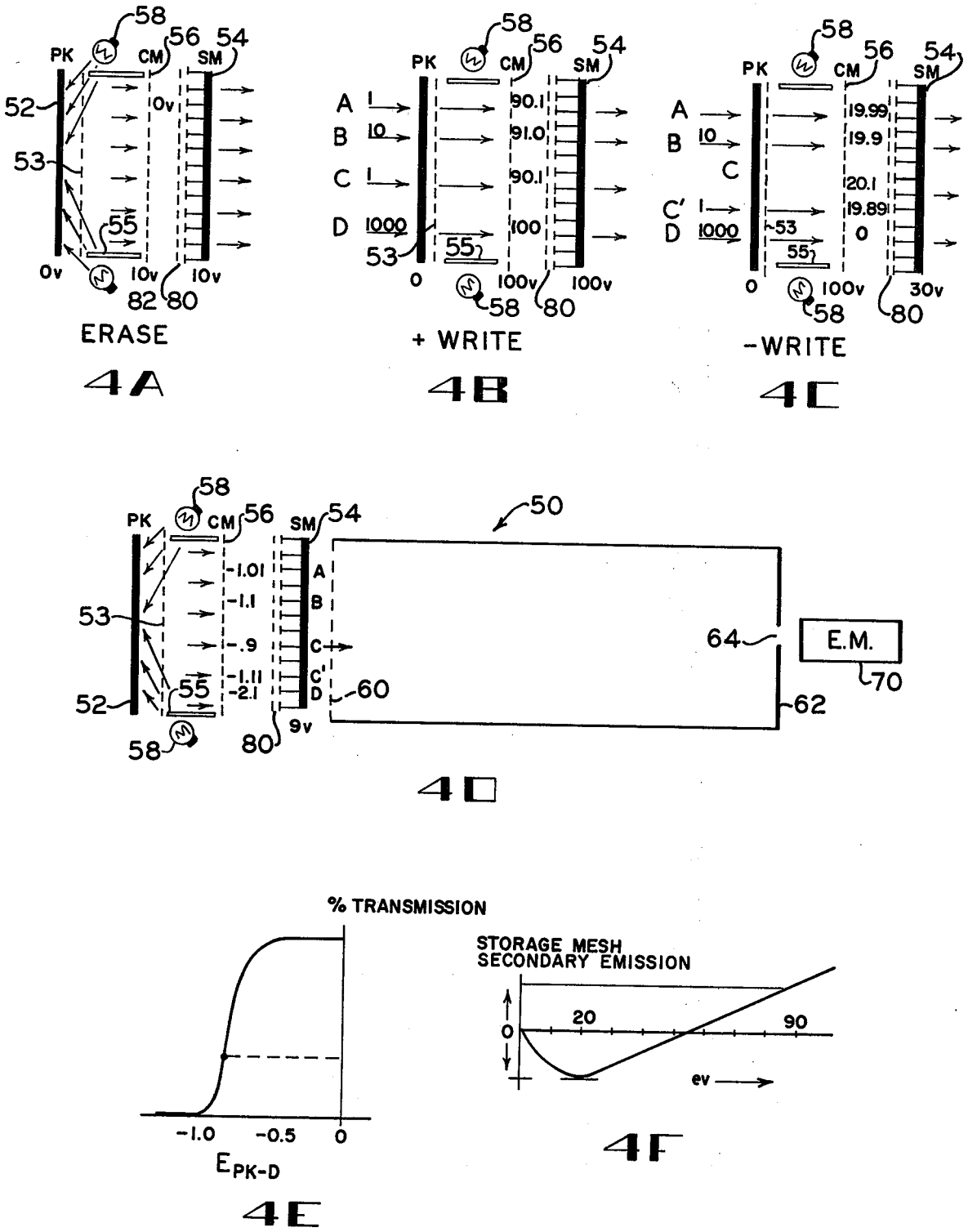
FIG. 4, comprising

Referring now to FIG. 4, an appreciation of the operational techniques of the invention may be had. It should be noted with respect to these figures that the voltage values associated therewith are for illustrative purposes only and any of numerous voltages could be utilized to effectuate the operational technique of the invention.

Referring now particularly to FIG. 4A, the operation of the tube 50 in the erase mode may be seen. At this point, the field mesh 53, the drift tube 55, the collector mesh 56 and storage mesh 54 are biased to a 10 volt level with the photocathode 52 being maintained at reference ground. The photocathode 52 is then flooded with high intensity light from the source 58 and a consequent uniform stream of electrons 82 is caused to impinge upon and pass through the storage mesh 54. As is well known in the art, the storage mesh 54 is coated with a dielectric so that it fundamentally functions as a myriad of independent capacitors 80 having one side thereof tied to the level of biasing of the mesh 54. With the uniform flood of high intensity light 58 causing a similar uniform flood of electrons from the photocathode 52, the plurality of capacitors 80 are brought to the reference level of the cathode 52.

As is common in the art, the storage mesh 54, after being erased, is then raised in biasing potential, for example to 100 volts, to operate in the positive writing mode. The faraday cage comprised of field mesh 53, drift tube 55, and collector mesh 56 is raised in bias voltage to provide a nodal focus on the storage mesh 54. The charge on the individual capacitors 80 is then effectively raised 90 volts evidencing the increase in potential of the storage mesh 54. At this time the photocathode 52 is exposed to a field of view having, as shown in FIG. 4B, light sources A, B, C and D of relative light magnitudes of 1:10:1:1000. It is assumed for purposes of discussion that a relative magnitude of 1 from a light source results in a 0.10 increase in voltage level at the capacitors 80 resulting from the corresponding electron emission from the photocathode 52. Consequently, the capacitor 80, receiving the electrons emitted by virtue of the presence of the light source A, will raise from the voltage level of 90 volts to 90.1 volts. Similarly, the capacitors 80 receiving the electrons emitted due to the presence of the light element B will raise 1 volt to 91 volts. The capacitor 80 corresponding with the light source C will raise 0.10 volts to 90.1 volts while the capacitors associated with the source D will raise to the limit of 100 volts since saturation of the associated capacitors occurs, for the example given, for relative brightness levels exceeding 100. This saturation is due to the storage mesh 54 also operating to collect the secondary electrons emitted from the dielectric. The advantage of using the storage mesh 54 to collect the secondary electrons will be evident later. At this point in time there is consequently stored upon the storage mesh 54 a distributive charge corresponding with the various light sources sensed during the time of exposure by the photocathode 52.

It is well known in the art that an optical image correlator may operate in a positive write mode as discussed hereinabove or may operate in a negative write mode as shall be discussed directly below. However, it is unique to the invention presented herein that the tube 50 of the invention is operative to glean information from a storage mesh which has been written onto in both a positive and negative write mode.

Referring now to FIG. 4C, the operation of the storage mesh 54 in the negative write mode may be considered. At this time the voltage level of the storage mesh 54 has been dropped from 100 volts to 30 volts and a consequent 70 volt drop is experienced in the charges of the capacitors 80. Again, the photocathode 52 is exposed to light sources A, B and D as discussed above. At this latter point in time however, the point C has moved to C′ thus representing that this light source is a moving element. At the time of beginning the negative write mode operation, all of the capacitors 80 which were not written onto during the positive write cycle will be at 20 volts due to the change in bias of the storage mesh 54. For purposes of this discussion it is presented that equal light magnitudes wll result in a 10% greater magnitude of charge storage upon the capacitors 80 than during the positive write cycle due to the inherent difficulties in obtaining exact cancellations when switching between modes. This characteristic is well known and understood by those skilled in the art and results in part from the variations in secondary emission characteristics at different areas of the storage mesh 54. Consequently, the charges deposited during the negative write mode will be 1.10 times the charges deposited during the positive write mode for equal light amplitudes.

It should now be appreciated that at the beginning of the negative write mode as shown in FIG. 4C the capacitor 80 corresponding to the point A will be charged to a value of 20.1 volts; the capacitor corresponding to point B will be charged to 21.0 volts; the capacitor 80 corresponding with the point C will be at 20.1 volts; the capacitor 80 corresponding to the point C′ will be at 20.0 volts; and the capacitor 80 corresponding to the point D will be at 30.0 volts. At the end of the negative write cycle, the respective capacitors will be charged to the values as indicated in FIG. 4C. This results from the capacitor dropping in voltage amounts equivalent to 1.10 times the respective light intensity of the associated light sources. The capacitor 80 associated with the source D would seek to drop to minus 80 volts but, due to the potential of the photocathode 52, is clamped at the reference level.

It should now be appreciated that the only difference in electric field between the positive write and the negative write occurs between the collector mesh 56 and storage mesh 54. Since this distance is small the distortion difference between the positive and negative write is minimized. It is now evident why the storage mesh 54 was used to collect the secondary electrons during the positive write. The small change in nodal focus occurring with the negative write potential on storage mesh 54 can be corrected by a slight adjustment in the focus coil 66 current.

With the storage mesh 54 having been doubly exposed by virtue of a positive and negative write cycle, it contains thereon information indicative of the static or dynamic characteristics of the light sources sensed. By reading the mesh 54 as shown in FIG. 4D, valuable, data relating to such characteristic may be readily ascertained. In entering into the read mode as shown in FIG. 4D, the storage mesh biasing potential is dropped to 9 volts; a drop of 21 volts from the negative write potential. Consequently, all of the points represented by the plurality of capacitors 80 which were not written into in either the positive or negative write modes are at a voltage level of minus 1 volt. All of the capacitors 80 which were written onto during the negative write mode are at a voltage level below minus 1.0 volt. Only the capacitor corresponding to the point C, the position of the moving target during the positive write mode, will be at a level greater than minus 1.0 volts. With an understanding of the charges upon the storage mesh 54, the actual operation during the read mode may now be appreciated. Again, the sources 58 cause a uniform flood of high intensity light to strike the surface of the photocathode 52 thus causing a uniform stream of electrons to be emitted therefrom and cast toward the storage mesh 54. By referring to the transconductance curve of FIG. 4E, it can be seen that there is a total cutoff of electron transmission through the storage mesh 54 at all points where the charge thereon is less than approximately minus 1.0 volt. In other words, the electrons are repelled at the storage mesh 54 at all points thereon where the charge thereof is less than minus 1.0 volt. Therefore electron transmission only occurs through the area of the storage mesh 54 corresponding to the point source C. These electrons are accelerated toward the aperture plate 62 by the field mesh 60 of the tube 50. By appropriately controlling the scan of the field comprising the storage mesh 54 by means of the minute aperture 64, the sensing and determination of the point of sensing of the source C can be achieved. Of course, the electrons passing through the aperture 64 are amplified by the electron multiplier 70 as mentioned hereinabove.

For purposes of fully understanding the operation of the invention as related in FIG. 4, FIG. 4F is presented for purposes of showing the variation of storage mesh charging current with respect to the biasing voltage of the storage mesh 54. This curve is, of course, well known and understood by those skilled in the art.

It should now be appreciated with respect to the discussion presented hereinabove that an electron stream will be transmitted from a point on the storage mesh corresponding to the positioning of a moving target during the positive write cycle. It should further be appreciated that an image dissector may be utilized to scan the field of storage mesh 54 to determine the position of such an object during that point in time and to ascertain the light amplitude thereof. The circuitry for achieving the control necessary for the tube 50 throughout all of the requisite modes thereof is shown in FIG. 5.

Figure 5:
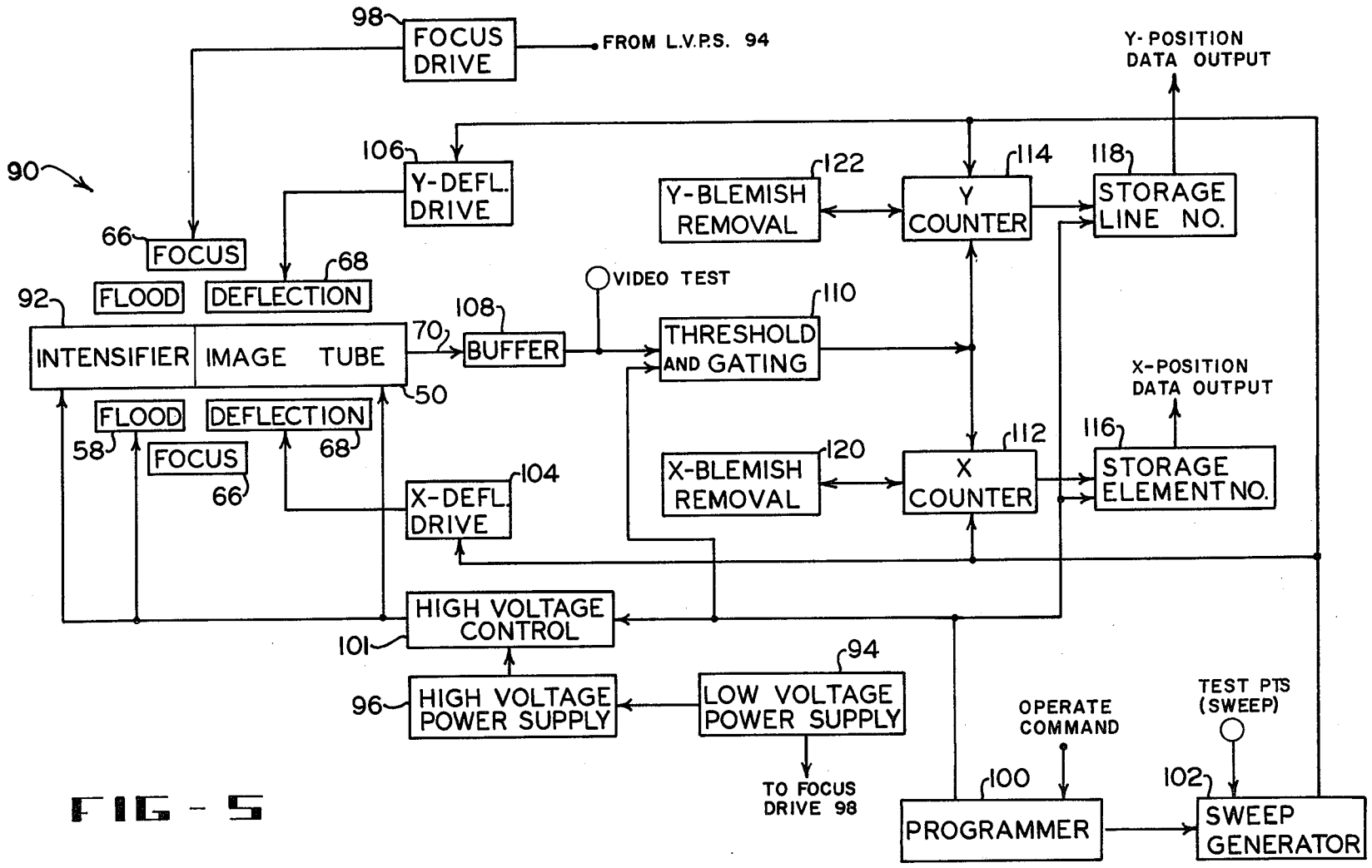
FIG. 5 is a schematic showing of the operational control circuitry of the invention.

Referring now to FIG. 5, an appreciation of the circuitry necessary for the operation of the instant invention may be had. This circuitry, designated generally by the numeral 90, is operative to relate with the tube 50 and its associated focus and deflection coils 66, 68 and flood illumination source 58. As can be seen, and as was discussed hereinabove, the tube 50 as shown in FIG. 5 is coupled to an intensifier 92 at the front end thereof for purposes of allowing the sensing of low level light sources such as satellites. The intensifier 92 may be of any suitable construction and is well known in the art. Indeed, the intensifier 92 could well be dispensed with if the sensing of higher light level moving objects were desired. Further included in the basic structure of the circuitry 90 is a low voltage power supply 94 and high voltage power supply 96, the former being operative to energize the focus drive circuitry 98. These basic elements 92–98, are so well known in the art that elaboration thereon is not made.

A programmer 100 which could indeed be replaced by a plurality of selector switches, is provided for purposes of centralized control of the circuitry. An appreciation of the requisite structure of the programmer 100 will be readily apparent when reference is made to FIG. 6 thereof. Suffice it to say at this time that the programmer 100 is operative through the high voltage control circuit 101 to control the biasing of the tube 50. The programmer 100 is further operable for controlling through the circuitry 101 the excitation of the flood illumination source 58 and the intensifier 92.

Of more importance to the operation of the instant invention is the control by means of the programmer 100 of the sweep generator 102. The sawtooth outputs of the sweep generator 102 are passed to the X and Y deflection drive circuits 104 and 106 whereby control of the deflection coils 68 is achieved as in a T.V. raster scan. The control of such deflection coils is elaborated upon in certain of the aforementioned U.S. Patents. It is the application of the proper voltages to the deflection coils 68 which provide for the dissecting of the image from the storage mesh 54 as described hereinabove. The Y deflection drive circuit 106 selects vertical lines of scan across the mesh 54 while the drive circuit 104 achieves the horizontal scan across the line selected by the circuit 106. Of course, the scan is actually achieved by magnetically deflecting the electron streams from sequential positions upon the mesh 54 through the aperture 64 of the plate 62.

As the image of the storage mesh 54 is dissected under control of the X and Y deflection circuits 104, 106, the outputs resulting from electrons passing through the aperture 64 are passed through the output line 70 and into the buffer circuit 108. From the circuit 108 the signals received from the dissecting of the mesh 54 are passed to the threshold and gating circuit 110 which is operative to merely determine whether the signals so received exceed a particular level. The particular level selected is one which would clearly indicate that the signal is indicative of a target or object and not a result of noise or error functions. Those signals which exceed the particular level are gated from the circuit 110 and into the X and Y counting circuits 112, 114. These counting circuits also receive the outputs of the sweep generator 102 such that the circuit 114 contains a count therein indicative of the vertical line of scan upon which the dissector section of the tube 50 is operating while the circuit 112 contains a count therein indicative of the horizontal position along this line of scan at any point in time. When a signal is emitted from the circuit 110, the counting circuits 112 and 114 are caused to transfer the respective counts therein into the associated storage circuits 116, 118. There is thus stored within the storage circuits, which may comprise nothing more than registers, data indicative of the positional relationship of a moving target upon the storage mesh 54. In other words, the threshold and gating circuit 110 is operative to gate the counts from the circuits 112, 114 to storage locations within the elements 116, 118. Transfer of data from the registers or storage elements of the circuits 116, 118 may be achieved under control of the programmer 100 in the well known fashion.

Those skilled in the art are aware that certain blemishes or imperfections are often present within a storage tube of the type disclosed and present inherent problems which must be overcome. For example, it is possible that a portion of the storage mesh 54 may be devoid of the dielectric coating necessary to effectively create the plurality of capacitors 80. The lack of such a coating results in a blemish therein which, when scanned by the dissector section of the tube 50, would result in an output signal of sufficient amplitude to trigger the threshold circuitry 110. Consequently, the tube 50 is preferably analyzed before use for the presence of such blemishes. By simply affectuating a positive and negative write upon the storage mesh 54 as shown in FIG. 4, without exposing the photocathode thereof to any external light sources will allow a determination in the read mode of those defect points on the mesh 54. Once the blemish points have been determined, simple blemish removal circuit 120, 122 may be interconnected with the appropriate counters 112, 114 to inhibit the gating of the counts contained therein to the storage elements 116, 118 when the scan is at a blemish point. The circuits 120, 122 merely inhibit the out gating of the associated counters at the predetermined blemish counts and can comprise simple decode circuits for the particular count at which the blemish occurs.

Figure 6:
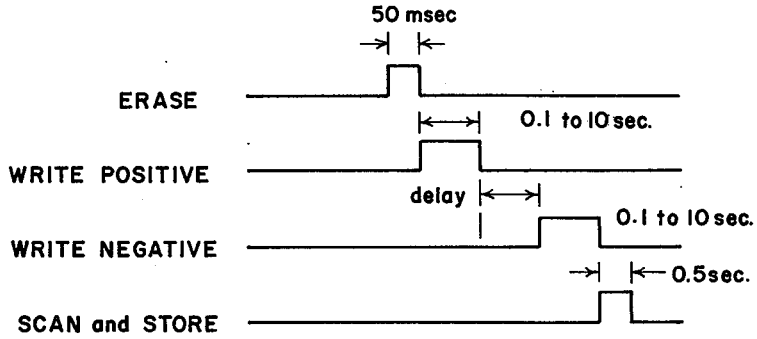
FIG. 6 is a timing chart relative to the operation of the circuitry of FIG. 5.

Referring now briefly to FIG. 6, an understanding of the simplistic mode of operation required by the programmer 100 may be seen. Initially, upon turning power on, an erase pulse of 50 milliseconds is provided whereby the flood sources 58 are illuminated for this short period of time while the storage and collector meshes are biased at the erase level. The positive write cycle is then entered into for a period of from 0.1 to 10 seconds and is shown in FIG. 4B. At this time, of course, the biasing of the appropriate meshes is controlled as shown in FIG. 4. A 0.10 to 10 second delay is then experienced before entering into the negative write mode which is preferably for the same time period as was the positive write cycle. Again, the biasing of the appropriate meshes is controlled by the programmer through the high voltage control in a fashion well known and understood by those skilled in the art. After the positive and negative write cycles have been completed the programmer 100 actuates the sweep generator 102 and clears the storage elements 116, 118 to begin the dissecting mode. The programmer again controls the biasing of the tube 50 through the high voltage control circuit 101 to operate in the read mode. At the end of the complete scan the positions of the responding elements are maintained within the storage elements 116, 118 and may be read therefrom under control of the programmer 100.

It should now be readily appreciated that the programmer 100 need only comprise a counting circuit operative to initiate in proper time sequence a plurality of one shots to achieve the technique of the invention. Indeed, the programmer could be totally manually controlled by means of a plurality of operator-actuatable switches which themselves trigger one shots of appropriate time duration.

Thus it can be seen that the objects of the invention have been met with the structure and techniques presented hereinabove. While in accordance with the patent statutes only the best mode and preferred embodiment of the invention have been presented and described in detail, it is to be understood that the invention is not limited thereto or thereby. Consequently, for an appreciation of the true scope and breadth of the invention reference should be had to the following claims.

What is claimed is:

1. Apparatus for determining the presence and position of a moving object within a field, comprising:

first means for emitting electrons as a function of the amplitude of light from the field incident thereto;

a storage mesh having a dielectric coating for receiving said electrons and storing a distributive charge thereon indicative of time related displacements of moving light levels within the field;

second means connected to said storage mesh for sequentially altering the biasing of said storage mesh between at least two potentials and thus enabling the storage mesh to receive and store a distributive charge thereon at each of said potentials;

third means for controllably scanning said second means and operative to create output signals as a function of the charge distribution on said second means, said third means comprising an aperture plate and deflection coils interposed between said storage mesh and said aperture plate; and circuit means connected to the deflection coils for controlling and regulating the path of electrons passing from the storage mesh to the aperture plate and position monitoring means connected to the circuit means for monitoring the position on the storage mesh from which the electrons passing to the aperture plate are being emitted.

2. The apparatus as recited in claim 1 wherein the circuit means further includes threshold gating means operative for sensing signals correlating to light levels exceeding a particular level.

3. The apparatus as recited in claim 2 which further includes position storage circuits interconnected between the threshold gating means and position monitoring means for storing data therein indicative of the position within the field of light elements exceeding a particular light level.

4. The method of utilizing a storage tube having a photocathode, storage mesh, aperture plate, and deflection coils for sensing the presence and position of a moving object within a static field, comprising the steps of:

A. Biasing the storage mesh at a first potential;

B. Exposing the photocathode to the static field and storing a distributive charge on the storage mesh indicative of the light levels within the static field at a first point in time;

C. Biasing the storage mesh to a second potential;

D. Exposing the photocathode to the static field and storing a distributive charge on the storage mesh indicative of the light levels within the static field at a second point in time;

E. Applying a third potential to the storage mesh of lesser amplitude than either of the two aforementioned potentials;

F. Passing an electron stream from the photocathode to the storage mesh; and

G. Exciting the deflection coils to scan the storage mesh by directing the electrons of the electron stream passing through various portions of the storage mesh through the aperture of the aperture plate.

5. The method as recited in claim 4 wherein the first potential is of a greater positive magnitude than the second potential.

6. The method as recited in claim 4 further including the step of initializing the storage tube by erasing the storage mesh by applying a fourth potential thereon below the magnitude of either the first or second potentials and passing an electron stream from the photocathode to the storage mesh.

* * * * *